US006874781B2

(12) United States Patent
Lai

(10) Patent No.: US 6,874,781 B2
(45) Date of Patent: Apr. 5, 2005

(54) MULTISTAGE PAPER HOLDING ROLLER DEVICE

(75) Inventor: Jin-Sheng Lai, Hsi Chih (TW)

(73) Assignee: Great Computer Corp. (TW)

( * ) Notice: Subject to any disclaimer, the term of this patent is extended or adjusted under 35 U.S.C. 154(b) by 191 days.

(21) Appl. No.: 10/390,627

(22) Filed: Mar. 19, 2003

(65) Prior Publication Data

US 2004/0183248 A1 Sep. 23, 2004

(51) Int. Cl.[7] ..... B65H 5/06
(52) U.S. Cl. ..... 271/264
(58) Field of Search ..... 271/264, 272, 271/273, 274, 275, 277; 198/836.2

(56) References Cited

U.S. PATENT DOCUMENTS 3,416,790 A * 12/1968 Davis ..... 271/273
5,182,861 A * 2/1993 Suzuki et al. ..... 33/18.1
5,351,945 A * 10/1994 Asakawa et al. ..... 271/118
5,762,332 A * 6/1998 Haroutel et al. ..... 271/274
6,557,850 B1 * 5/2003 Kallin et al. ..... 271/274
6,651,975 B2 * 11/2003 Ohtsuka et al. ..... 271/145
2003/0057628 A1 * 3/2003 Grasmuck et al. ..... 271/1

FOREIGN PATENT DOCUMENTS

JP 5-246595 A * 9/1993 ..... B65H/29/20

* cited by examiner

*Primary Examiner*—Donald P. Walsh
*Assistant Examiner*—Mark J. Beauchaine
(74) *Attorney, Agent, or Firm*—Dennison, Schultz, Dougherty & MacDonald

(57) ABSTRACT

A device includes: a supporting seat mounted on a rail of an output equipment for adjusting its working position; a cantilever pivotally provided beneath the supporting seat to be in the form of a sea-saw, and provided on one end thereof with a roller; and at least a set of pressure adjusting mechanism arranged between the cantilever and the supporting seat, each set of the pressure adjusting mechanisms is comprised of an adjusting moving piece and a spring. By adjustment of the adjusting moving piece, the stretching force of the spring can be changed, so that the down pressing force of the roller on one end of the cantilever can be changed.

3 Claims, 8 Drawing Sheets

MULTISTAGE PAPER HOLDING ROLLER DEVICE

BACKGROUND OF THE INVENTION

1. Field of the Invention

The present invention is related to a multistage paper holding roller device, and especially to such a multistage paper holding roller device which can have a plurality of adjusting moving pieces moved to generate multistage pressures for holding a paper, it suits output equipments such as a computer character-cutting device or a printer etc.

2. Description of the Prior Art

As shown in FIG. 1 which shows the structure of a conventional paper holding roller device 1, the device includes a supporting seat 11, a cantilever 12 and a spring 13, wherein the cantilever 12 is provided on one end thereof with a paper holding roller 121; the supporting seat 11 is pivotally provided on the cantilever 12; one end of the spring 13 is hooked on the supporting seat 11, while the other end is hooked on the cantilever 12. Hence, by elongation and contraction of the spring 13, the cantilever 12 is moved to adjust the pressure on the paper.

When the above stated structure is in use, the paper holding roller 121 is always set to press down, this makes inconvenience of position adjustment; in view of this, the inventor of the present invention designed a former invention which is a paper holding roller device with a position-adjusting clip 124, when in adjusting position, the paper holding roller 121 can be temporarily raised for the convenience of position adjustment.

However, as to the structures of the above stated two kinds of paper holding roller devices, the springs are directly hung on the supporting seats, the paper holding roller devices can only create a single kind of pressure for both case when in operation, they can meet the requirements for operation, but their functions is inferior when in more precise processing or the paper used require a different appropriate pressure. This is because when an equipment is to give a more precise output, the situation is just like to draw on (or to cut) a paper; the force for pressing the paper must be tender, and the speed of drawing must be slow, and then an extremely precise pattern can be drawn or cut off. On the contrary, if it is to maintain the output speed, while the force of holding a paper can be adjusted to have multiple stages, the qualities of outputs in various situations are different. The above stated two kinds of conventional paper holding roller devices are unable to meet the requirement of superior output.

In view of the above defects resided in the conventional paper holding roller devices, the present invention was developed to make its paper holding roller device provide more precise or more variant output.

SUMMARY OF THE INVENTION

The primary object of the present invention is to provide a multi-sectional paper holding roller device which can have a controlling function on multiple pressures.

In order to get the object of the present invention, the multi-sectional paper holding roller device of the present invention includes: a supporting seat mounted on a rail of an output equipment for adjusting its working position, a cantilever pivotally provided beneath the supporting seat to be in the form of a sea-saw, and is provided on one end thereof with a roller; and at least a set of pressure adjusting mechanism arranged between the cantilever and the supporting seat, each set of pressure adjusting mechanisms is comprised of an adjusting moving piece and a spring. By adjustment of the adjusting moving piece, the stretching force of the spring can be changed, so that the down pressing force of the roller on one end of the cantilever can be changed.

The present invention will be apparent after reading the detailed description of the preferred embodiment thereof in reference to the accompanying drawings.

DETAILED DESCRIPTION OF THE PREFERRED EMBODIMENT

Figure 1:
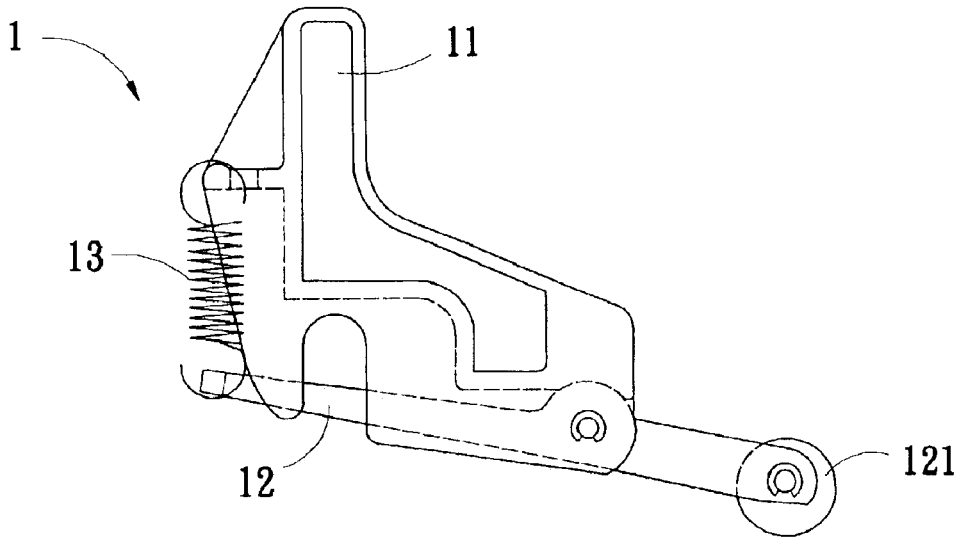
Fig. 1 (Prior Art)
FIG. 1 is a side view of a conventional paper holding roller device.
Figure 2:
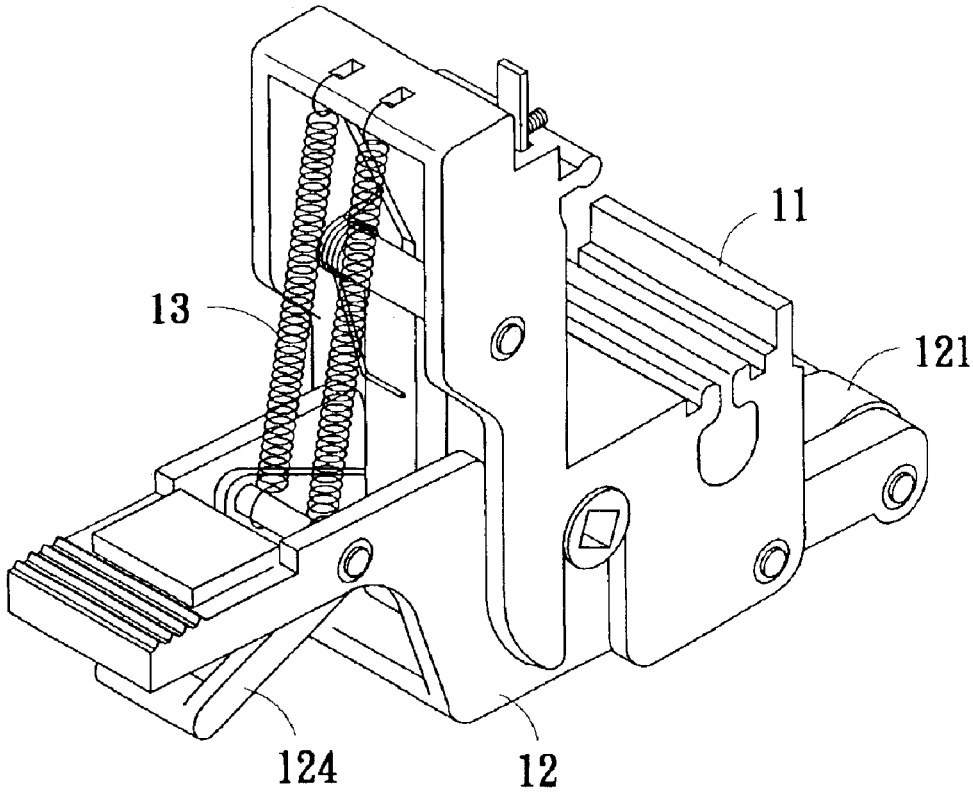
Fig. 2 (Prior Art)
FIG. 2 is a perspective view showing the appearance of another conventional paper holding roller device.
Figure 3:
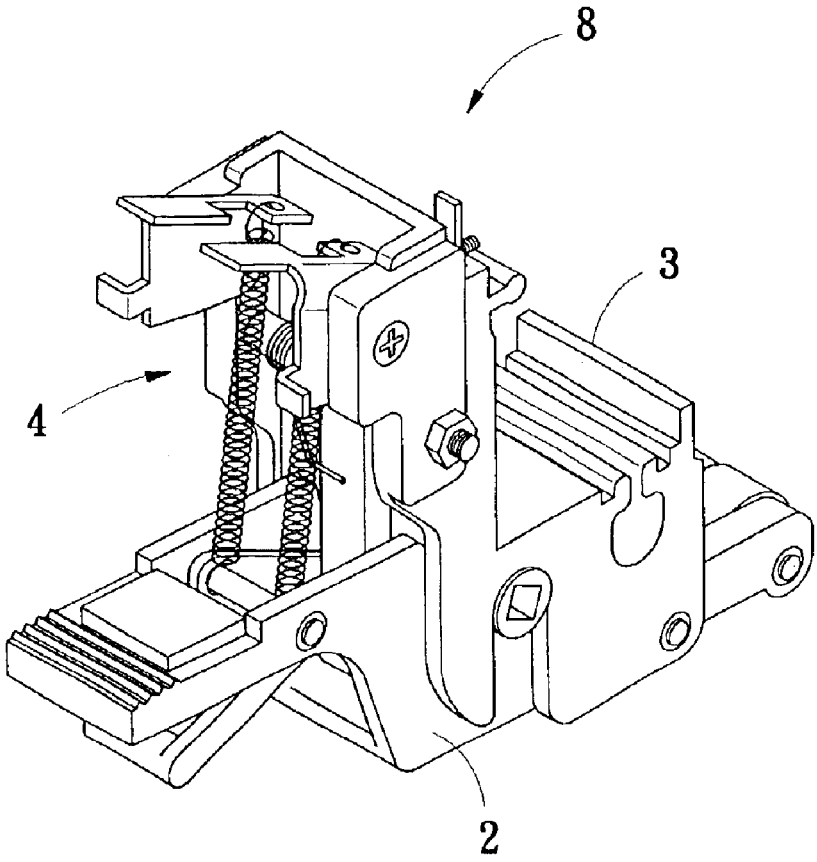
FIG. 3 is a perspective view showing the appearance of the paper holding roller device of the present invention.
Figure 4:
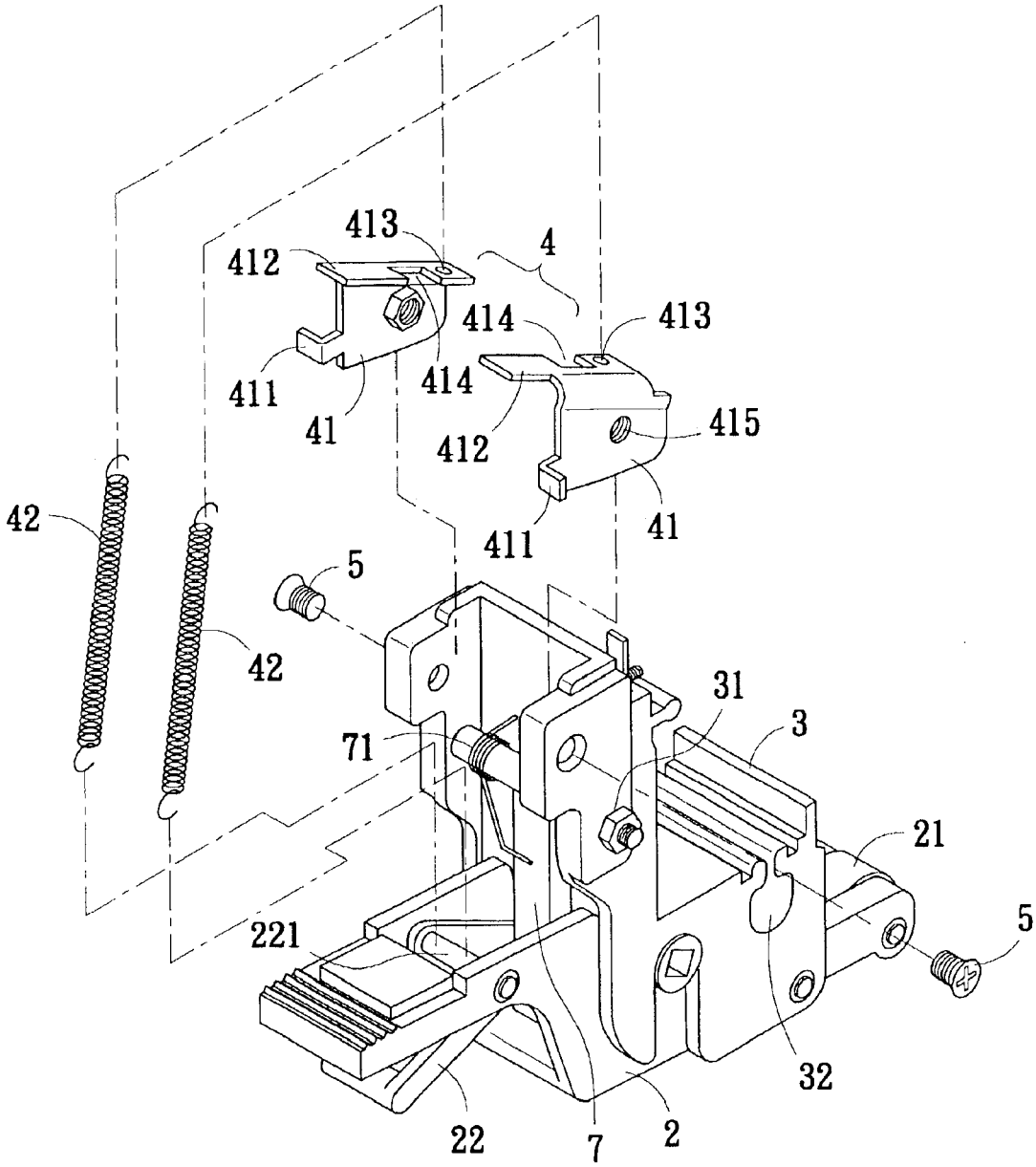
FIG. 4 is an analytic perspective view of a pressure adjusting mechanism of the present invention.
Figure 5:
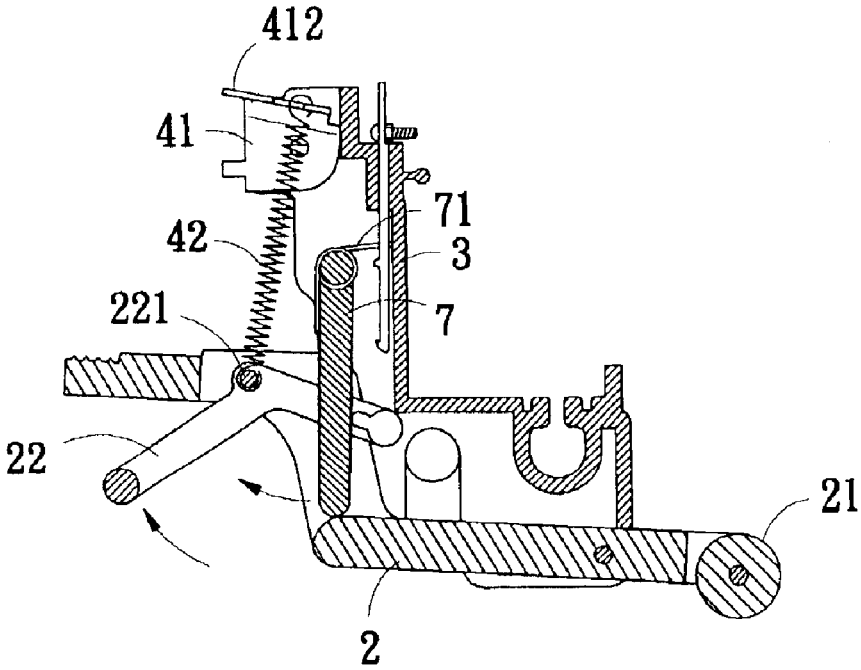
FIG. 5 is a sectional schematic view showing the state when the position-adjusting clip of the paper holding roller device of the present invention is to be pressed.
Figure 6:
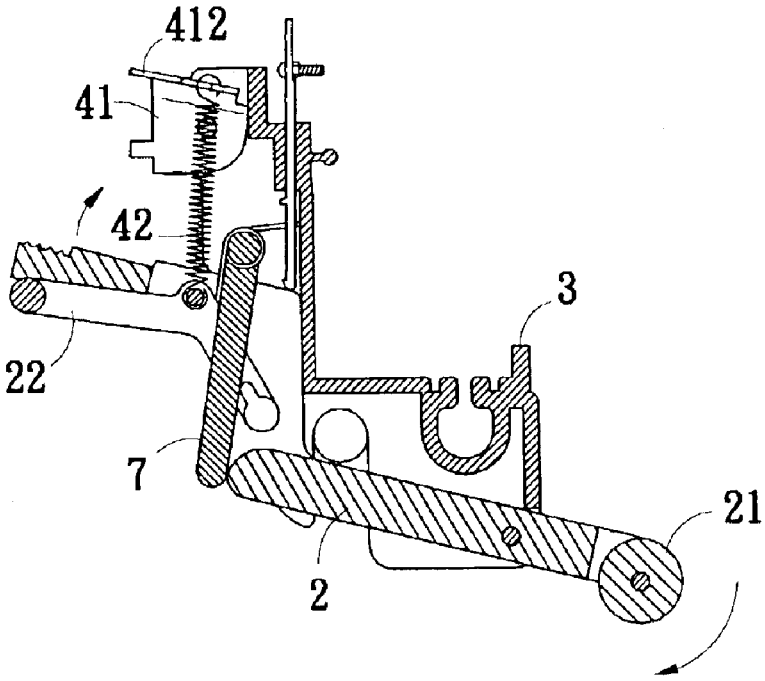
FIG. 6 is a sectional schematic view showing the state when the position-adjusting clip of the paper holding roller device of the present invention has been pressed to clamp.
Figure 7:
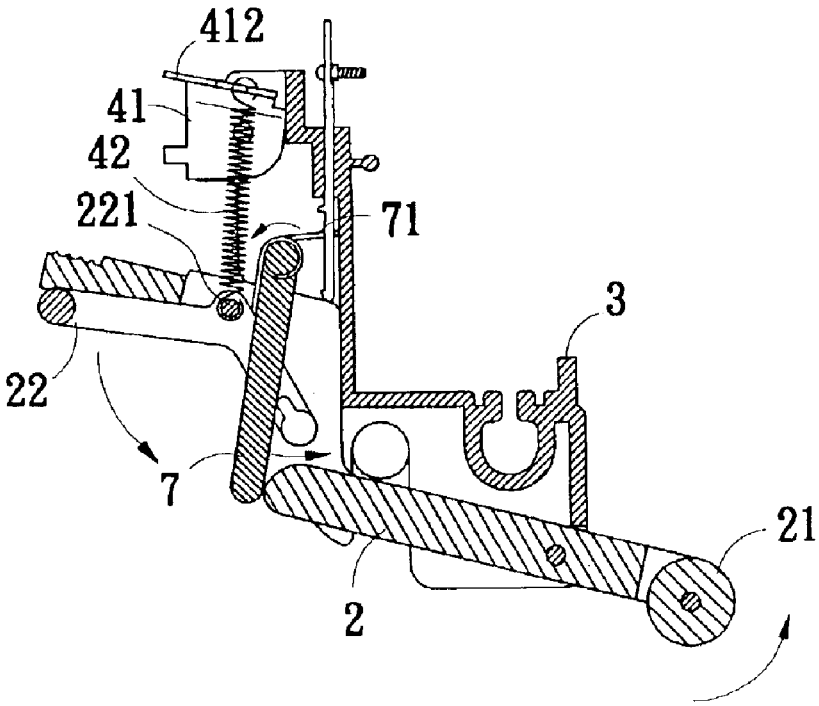
FIG. 7 is a sectional schematic view showing the state when the position-adjusting clip of the paper holding roller device of the present invention is to be pulled to open.
Figure 10:
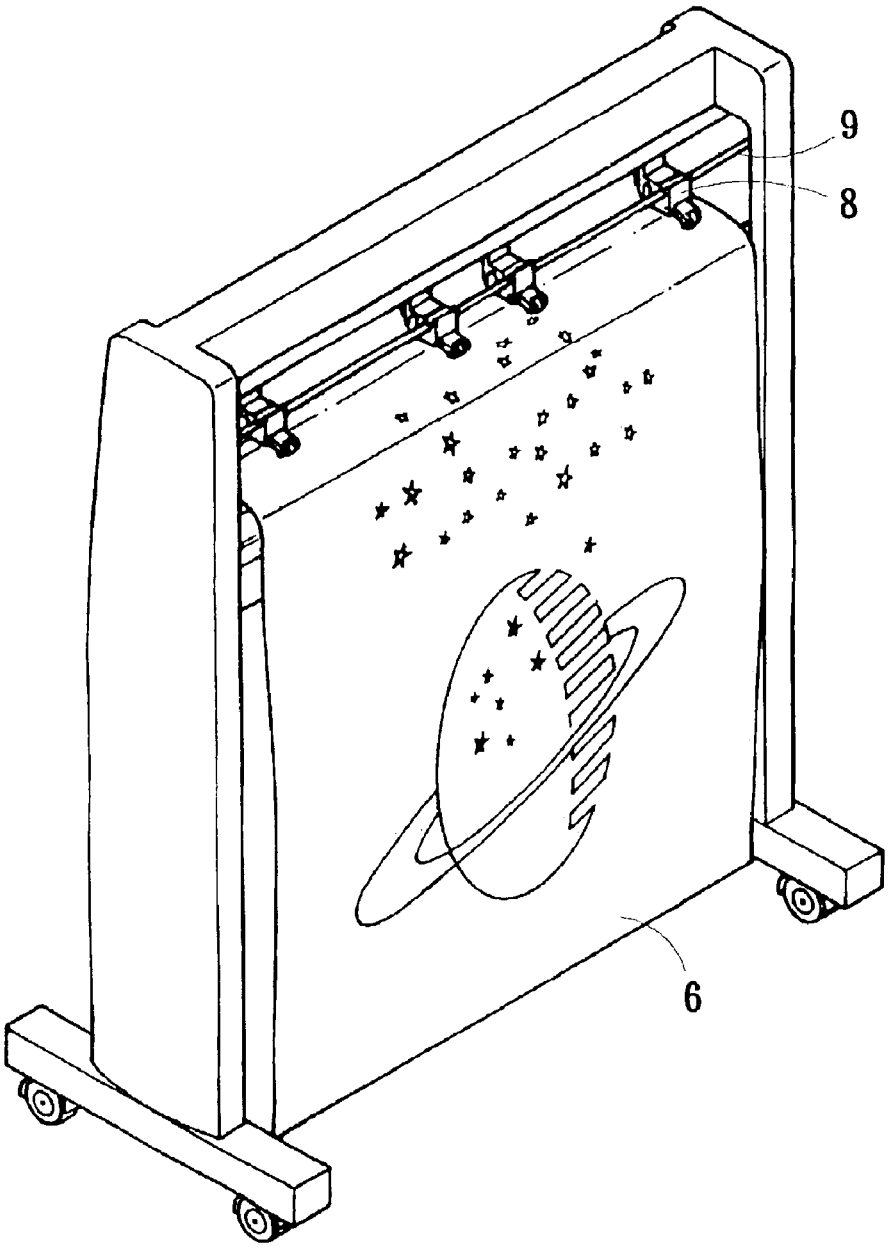
FIG. 10 is a perspective schematic view showing the paper holding roller device of the present invention is provided on a character-cutting device.

Referring firstly to FIGS. 3 and 4 showing a multistage paper holding roller device 8 of the present invention, the device 8 includes a supporting seat 3, a cantilever 2 and two sets of pressure adjusting mechanisms 4. Wherein the supporting seat 3 is mounted on a rail 9 of an output equipment for adjusting its working position (as shown in FIG. 10); the cantilever 2 is pivotally provided beneath the supporting seat 3 to be in the form of a sea-saw, and is provided on one end thereof with a roller 21; and the two sets of pressure adjusting mechanism 4 are arranged between the cantilever 2 and the supporting seat 3, each set of the pressure adjusting mechanisms 4 is comprised of an adjusting moving piece 41 and a spring 42. By adjustment of the adjusting moving piece 41, the stretching force of the spring 42 can be changed, so that the down pressing force of the roller 21 on one end of the cantilever 2 can be changed.

Referring to FIGS. 4–7, when in practicing, the other end of the cantilever 2 is provided with a position-adjusting clip 22, and the two lateral sides of the supporting seat 3 perpendicular to the cantilever 2 are correspondingly provided each with a locking hole 31 to allow a T shaped rod 7 to be locked in the supporting seat 3, and the bottom of the T shaped rod 7 can contact the cantilever 2. The T shaped rod 7 is provided on the upper end thereof with a torsional spring 71 in order to move the T shaped rod 7 to change the displacement of the roller 21 when the position-adjusting clip 22 is pressed or pulled to open. The supporting seat 3 further is provided with a through hole 32 for adjustment of the working position of the paper holding roller device 8 mounted on the rail 9 (as shown in FIG. 10).

In addition to this, as shown in FIG. 4, the two sets of pressure adjusting mechanism 4 are comprised each of an adjusting moving piece 41 and a spring 42, and are arranged between the cantilever 2 and the supporting seat 3. The adjusting moving piece 41 is in the form of a gauge block with a central screw hole 415, it is locked on and connected with the upper portion of a U shaped inner wall of the supporting seat 3 by using a screw 5; one side of the adjusting moving piece 41 is provided with a folded stop piece 411, the other side thereof is folded to form a holding panel 412. The holding panel 412 is provided near an end with a through hole 413 and a notch 414 for hooking of the spring 42; the other end of the spring 42 is hooked on a middle axle 221 on the position-adjusting clip 22.

Figure 8:
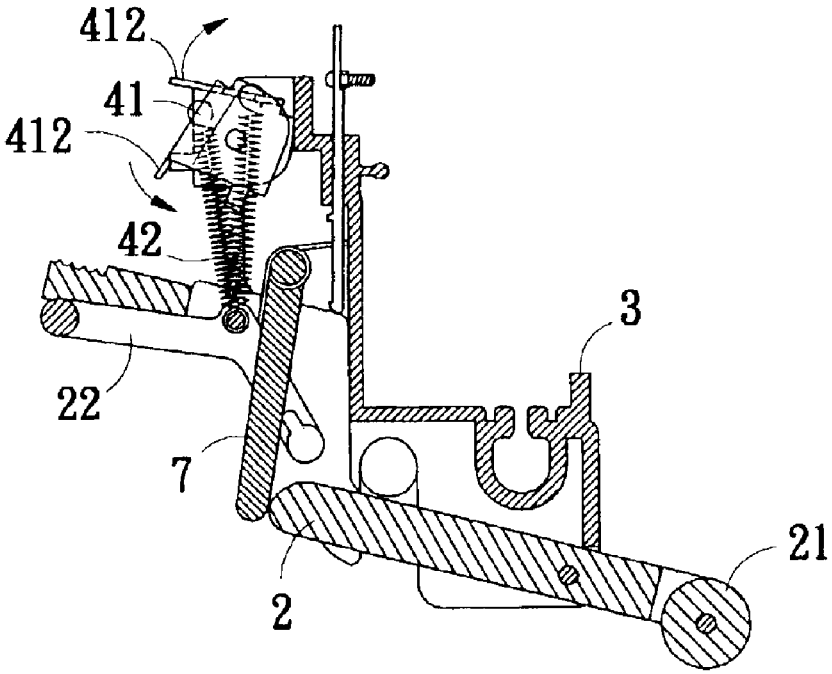
FIG. 8 is a sectional schematic view showing the action when the adjusting moving piece of the present invention is moved up and down.
Figure 9:
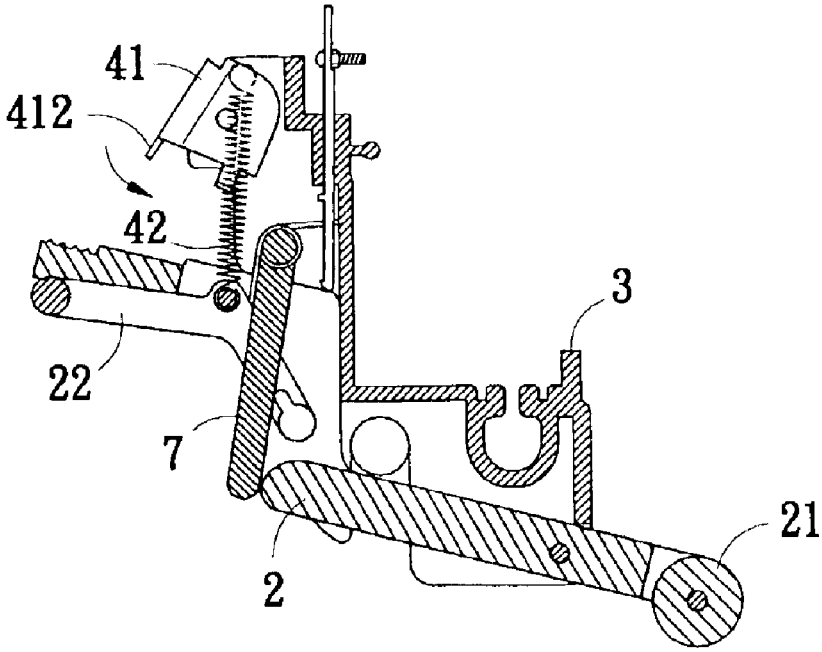
FIG. 9 is a sectional schematic view showing the action when the adjusting moving piece of the present invention is moved down.

With the feature of using the two adjusting moving pieces 41 in the present invention, the two adjusting moving pieces 41 can be moved both upwardly, one up one down or both downwardly (as shown in FIGS. 8 and 9), so that when in using the paper holding roller device, by adjustment of the stretching of the spring 42 by moving the two adjusting moving pieces 41 with the holding panel 412, the degree of pressure that a paper 6 is subjected can be more variant in pursuance of various moving modes of the two adjusting moving pieces 41 for more precise cutting.

Accordingly, the present invention is advantageous in that, it change the paper holding roller device only with a single option of pressure conventionally to the multistage paper holding roller device including a heavy, a middle and a light stage of pressing to be selected for adjustment, the present invention suits the requirements of various qualities of cutting; even when under the same pressing force, by appropriate downward adjusting of the pressure of the paper holding roller device with the improved design of the present invention, the cutting work done can be more precise, thereby, the object that the quality of cutting is practically elevated can be achieved.

In conclusion, the present invention can surely acquire its expected object to provide a multistage paper holding roller device, it is thereby industrially valuable; therefore, what I claim as new and desire to be secured by Letters Patent of the United States are:

What is claimed is:

1. A multistage paper holding roller device for using on an output equipment, said device is adapted to adjustment of working position when in use, and is comprised structurally of:

a supporting seat mounted on a rail of an output equipment for adjusting its working position;

a cantilever pivotally provided beneath said supporting seat to be in the form of a sea-saw, and is provided on one end thereof with a roller; and at least a set of pressure adjusting mechanism arranged between said cantilever and said supporting seat, each set of said pressure adjusting mechanisms is comprised of an adjusting moving piece and a spring; by adjustment of said adjusting moving piece, the stretching force of said spring is changed, so that the down pressing force of said roller on one end of said cantilever is changed.

2. The multistage paper holding roller device as in claim 1, wherein the other end of said cantilever is provided with a position-adjusting clip, and the two lateral sides of said supporting seat perpendicular to said cantilever are correspondingly provided each with a locking hole to allow a T shaped rod to be locked in said supporting seat, and the bottom of said T shaped rod is adapted to contacting said cantilever in order to move said T shaped rod to change the displacement of said roller when said position-adjusting clip is pressed or pulled to open.

3. The multistage paper holding roller device as in claim 2, wherein said adjusting moving piece is in the form of a gauge block with a central screw hole, and is locked on and connected with the upper portion of a U shaped inner wall of said supporting seat by using a screw; one side of said adjusting moving piece is provided with a folded stop piece, the other side thereof is folded to form a holding panel; said holding panel is provided near an end with a through hole and a notch for hooking of said spring; the other end of said spring is hooked on a middle axle on said position-adjusting clip.

* * * * *